US007243396B2

(12) United States Patent
Vanini

(10) Patent No.: US 7,243,396 B2
(45) Date of Patent: Jul. 17, 2007

(54) DOOR HINGE

(75) Inventor: Marco Vanini, Bologna (IT)

(73) Assignee: Nuova Star S.p.A., Zola Predosa, Bologna (IT)

( * ) Notice: Subject to any disclaimer, the term of this patent is extended or adjusted under 35 U.S.C. 154(b) by 0 days.

(21) Appl. No.: 11/151,536

(22) Filed: Jun. 14, 2005

(65) Prior Publication Data

US 2006/0053589 A1 Mar. 16, 2006

(30) Foreign Application Priority Data

Sep. 14, 2004 (IT) ..... BO2004A0566

(51) Int. Cl.
*E05F 1/08* (2006.01)

(52) U.S. Cl. ..... 16/286

(58) Field of Classification Search ..... 16/286, 16/289–292, 297, 287, 389, 233, 281, 256, 16/322, 355; 126/194, 191; 49/386, 387, 49/389, 398, 402

See application file for complete search history.

(56) References Cited

U.S. PATENT DOCUMENTS 2,198,346 A * 4/1940 Little ..... 126/191
2,579,091 A * 12/1951 Rinaldo ..... 16/245
3,749,080 A * 7/1973 Kleinhenn ..... 126/191
4,665,892 A * 5/1987 Spargo et al. ..... 126/194
4,960,297 A * 10/1990 Bouse et al. ..... 292/223
5,025,776 A * 6/1991 Hanley et al. ..... 126/194
6,035,848 A * 3/2000 Ray et al. ..... 126/194
6,442,799 B1 * 9/2002 Duarte et al. ..... 16/277

FOREIGN PATENT DOCUMENTS

DE 4105274 A * 11/1991
DE 4108816 A1 * 9/1992
EP 149937 A1 * 7/1985
FR 2401296 A * 4/1979
GB 2235723 A * 3/1991
GB 2252787 A * 8/1992

* cited by examiner

*Primary Examiner*—Chuck Y. Mah
(74) *Attorney, Agent, or Firm*—The Nath Law Group; Jerald L. Meyer; Matthew J. Moffa

(57) ABSTRACT

A door hinge includes a first element, a second element and a lever connecting the first and second elements to each other. The lever is pivoted on the second element and has a first portion attached to the first element to make the first and the second element reciprocally mobile about a horizontal axis. The second element includes a box-shaped body housing elastic means acting in conjunction with a second portion of the lever to control the reciprocal motion of the first and the second element. The first element and the lever constitute a rocker lever pivoted on the second element and in which a first arm of the first element rotates in a plane outside the box-shaped body and parallel to the plane in which the second arm of the rocker lever lies.

9 Claims, 5 Drawing Sheets

DOOR HINGE

BACKGROUND OF THE INVENTION

The present invention relates to a door hinge.

The use of a hinge made in accordance with this invention is particularly advantageous for connecting the door of a domestic appliance, especially a washing machine or dishwasher, to which this specification refers but without thereby restricting the scope of the invention.

In traditional washing machines or dishwashers, the door hinges consist of two separate elements, both of which usually have a box-shaped structure and which are kinematically linked to each other.

More specifically, one of the two box-shaped structures is fixed to one side of the washing machine or dishwasher opening, whilst the other is fixed to one edge of the door of the appliance which can thus be tilt opened with respect to the opening.

Between the box-shaped structures there is an operatively interposed lever, normally a rocker lever, which is pivoted to one of the two box-shaped structures and has a first arm that is rigidly linked to the other box-shaped structure.

The second arm of the lever, lying in the same plane as the first, is operated upon by elastic elements for controlling door opening. The elastic elements are housed in the box-shaped structure to which the lever is hinged. The purpose of the elastic elements is to enable the door first to turn rapidly in the opening direction through a predetermined angle and then, by opposing the downward force created by the weight of the door, to gradually slow down the rotational opening movement until the door reaches the fully open position.

In prior art hinges, the box-shaped structure on which the lever is pivoted has a rectangular slot that enables the lever to move all the way back into the box-shaped structure when the door is closed.

It has been found that when the washing machine or dishwasher is opened at the end of, or even during, a washing cycle, the steam that has formed inside it tends to condense in the box-shaped structure that houses the above mentioned elastic control elements. The steam easily finds its way into the box-shaped structure through the above mentioned slot, quickly cools and condenses inside the box-shaped structure.

The condensed steam collects in the box-shaped structure and facilitates the accumulation of dirt and grime around the elastic control elements, often leading to malfunctioning. This problem has been found not only in traditional washing machines or dishwashers, with front loading, but also in top-loading washing machines or dishwashers.

SUMMARY OF THE INVENTION

This invention has for an aim to provide a door hinge that overcomes the drawback described above.

In accordance with the invention the above aim is achieved by a door hinge having the characteristics described in claim 1.

The dependent claims refer to preferred, advantageous embodiments of the invention.

BRIEF DESCRIPTION OF THE DRAWINGS

Preferred embodiments of the invention will now be described, without restricting the scope of the inventive concept, with reference to the accompanying drawings in which.

DESCRIPTION OF THE PREFERRED EMBODIMENTS

Figure 1:
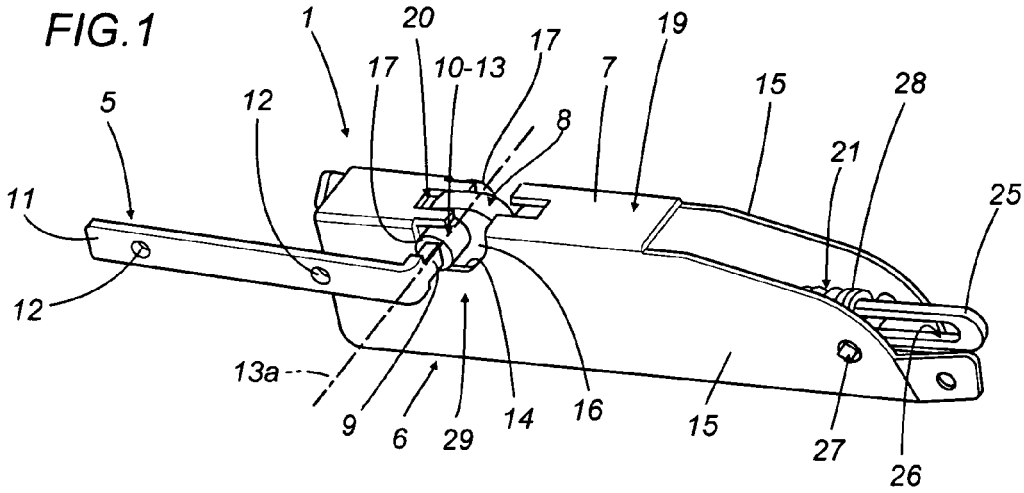
FIG. 1 is a perspective view of a first embodiment of the hinge according to the present invention, showing the hinge in the closed position.
Figure 2:
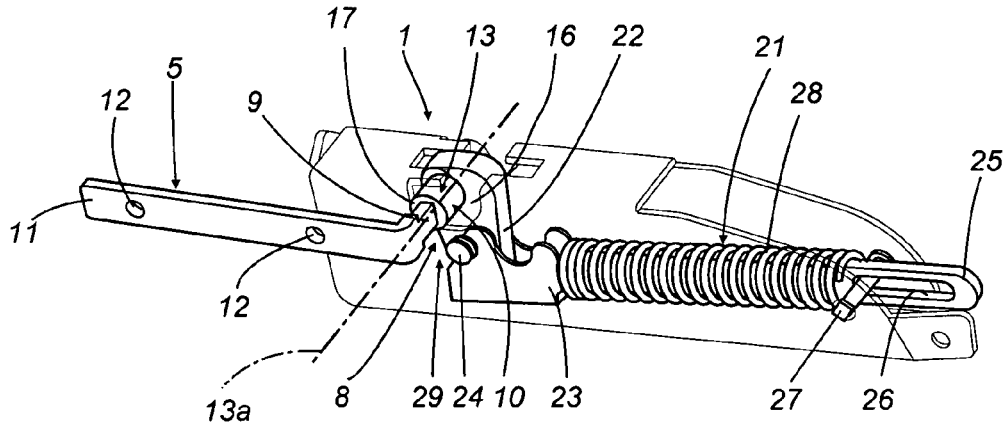
FIG. 2 is another view of the hinge of FIG. 1 with an outside portion of it cut away in order to better illustrate the parts inside the hinge.

In FIGS. 1 to 6, the reference numeral 1 denotes a door hinge in its entirety.

Figure 3:
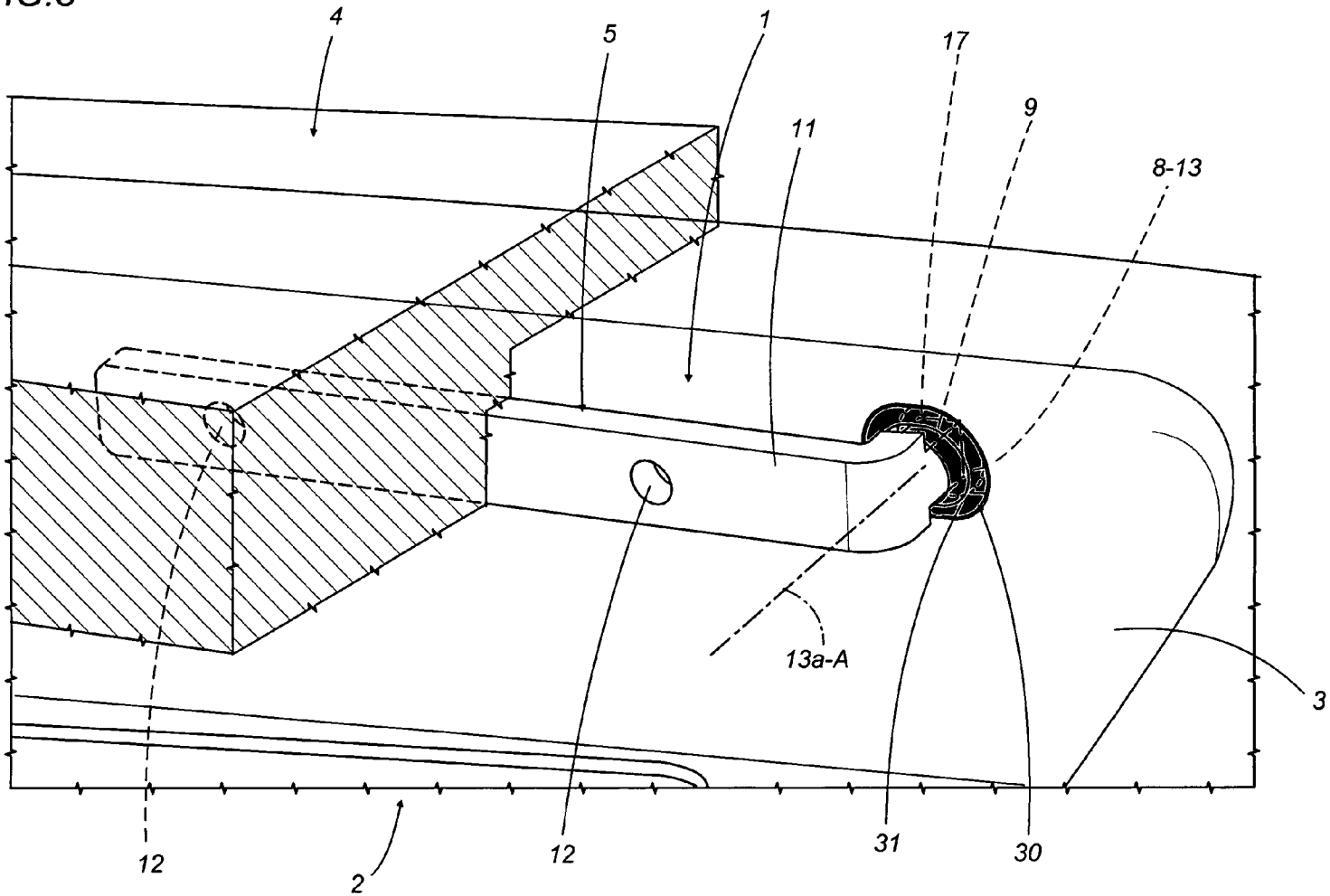
FIGS. 3 and 3*a* show the hinge of FIG. 1 fitted to a domestic appliance.
Figure 3A:
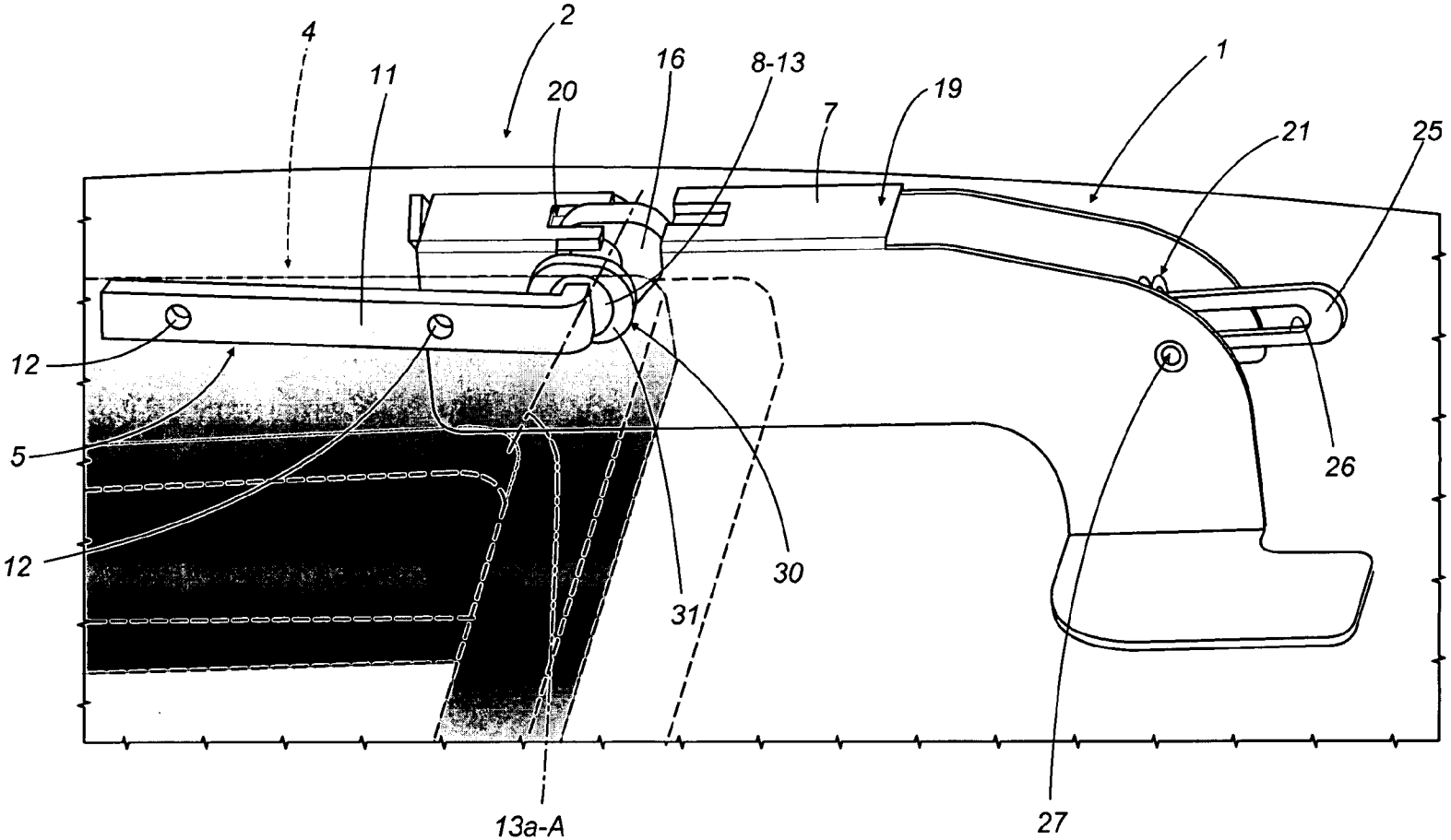

The hinge 1 is particularly suitable for a domestic appliance, especially, as shown in FIGS. 3 and 3*a*, a top loading washing machine or dishwasher 2.

The washing machine or dishwasher 2 comprises a casing or frame 3 to the sides of which a door 4 is connected by two hinges 1 which enable it to be rotated about a horizontal axis A in order to open it.

Each of the two hinges 1 comprises: a first element 5 designed to support a respective side of the door 4; a second element 6, defined by a box-shaped body 7, designed to be supported and wholly enclosed and protected by a respective side of the casing 3; and a connecting lever 8 that kinematically links the first element 5 and the second element 6 to each other.

The first element 5 is defined by an L-shaped supporting bracket having a first wing 9, fixed to a first portion 10 of the lever 8, and a second wing 11, extending at right angles to the first wing 9 and having a plurality of through holes 12 by which it can be attached using screws (not illustrated) to a respective side of the door 4.

The first portion 10 of the lever 8 defines a rotation pin 13 by which the lever 8 is pivoted on two housings 14 of the second element 6 in such manner as to make the first element 5 and the second element 6 reciprocally mobile about a horizontal axis 13*a* running through the center of the pin 13 itself. When the door 4 is connected to the casing 3 by means of the two hinges 1, the hinge axes 13*a* define the aforementioned horizontal axis A about which the door can be rotated with respect to the casing 3.

The housings 14 are made in two respective opposite side walls 15 of the aforementioned box-shaped body 7 and together support the pin 13 like a fork.

The pin 13 extends at right angles from both sides of a central body 16 forming part of the lever 8 and extending principally lengthways in a radial direction of the pin 13.

The first wing 9 is fixed to the pin 13 as an axial extension of the latter and, more specifically, is fixed to one of the two opposite longitudinal ends 17 of the pin 13.

The ends 17 define respective fittings 18 for quickly connecting the first wing 9 to the lever 8.

As shown by way of example in FIGS. 1 to 6, the fittings 18 are defined by parallelepiped shaped cavities designed to accommodate, substantially without play, a parallelepiped shaped end of the first wing 9. The presence of two fittings 18, one at each end, means that the hinge 1 can be used both as a left-hand hinge and as a right-hand hinge.

The ends 17, and hence the fittings 18, protrude from the respective side walls 15 of the box-shaped body 7, and can therefore be accessed from the outside of the box-shaped body 7 at the aforementioned housings 14.

In addition to the side walls 15, the box-shaped body 7 comprises a wall 19 that connects the side walls 15 across their top edges, whilst it is open at the bottom on the side opposite the wall 19.

The wall 19, which is positioned at the top when the hinge 1 is fitted, has an opening 20, extending across the two housings 14 so as to connect the housings 14 to each other, and designed to facilitate access to the lever 8 not only to fit the hinge 1 but also for maintenance purposes, when required. The opening 20 may be closed by a cover that is not illustrated.

Between the side walls 15, the box-shaped body 7 contains elastic means 21 designed to act in conjunction with a second portion 22 of the lever 8 to control the reciprocal motion of the first element 5 and of the second element 6. The second portion 22 is defined by an end of the lever 8 at the end of the pin 13 on the opposite side of the central body 16.

The elastic means 21 comprise: a fork 23, coupled with a pin 24 of the lever 8 extending at right angles from both sides of the portion 22; a rod 25 fixed at one longitudinal end to the fork 23 and having, at the opposite longitudinal end, a slot 26 slidably coupled with a pin 27 which extends at right angles between the side walls 15; and a pre-compressed helical spring 28 coaxial with the rod 24 and fitted between the fork 23 and the pin 27.

When the door 4 is rotated about the axis A, thereby rotating the elements 5 about their respective axes 13*a*, the pushing force of the spring 28 acts on the lever 8 with a variable lever arm according to the angular position of the door 4 and, hence, of the lever 8. In particular, the action of the spring 28 is variable and concordant with that of the user when the door 4 is opened, whilst it is variable and discordant when the door is closed. The variability of the action of the spring 28 is defined by the geometry of the lever 8, that is, by the distance of the pins 13 and 24, and by the geometry of the elastic means 21.

Figure 4:
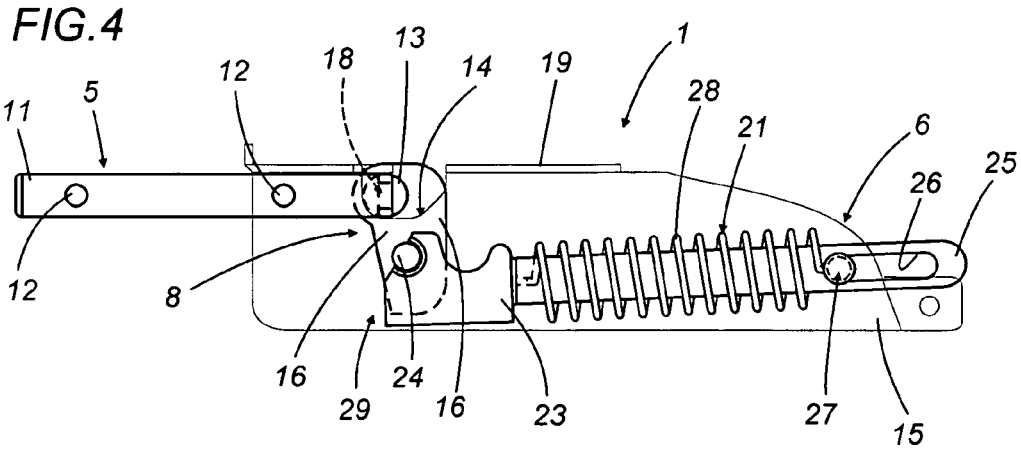
FIGS. 4, 5 and 6 are three side views of the hinge of FIG. 1 shown in the closed position, in an intermediate open position and in the fully open position, respectively.
Figure 5:
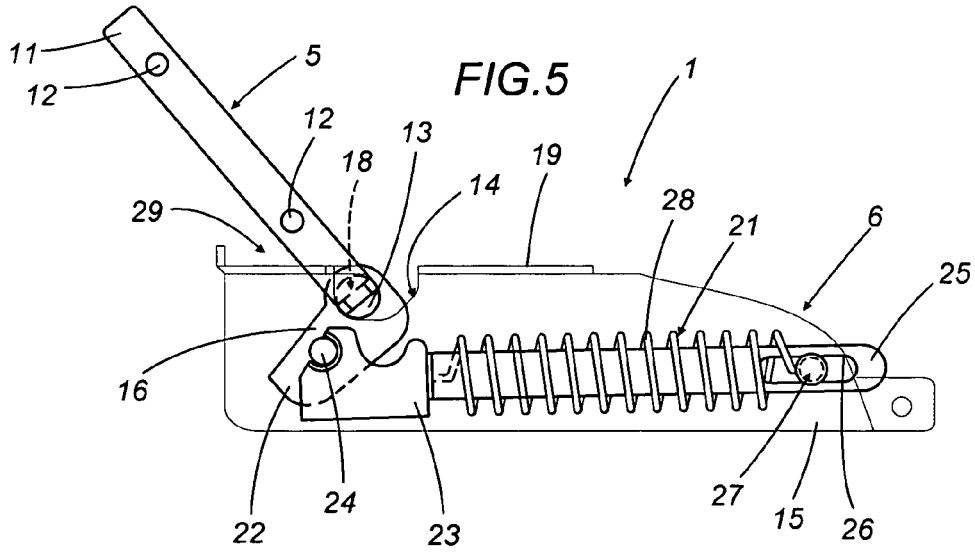
Figure 6:
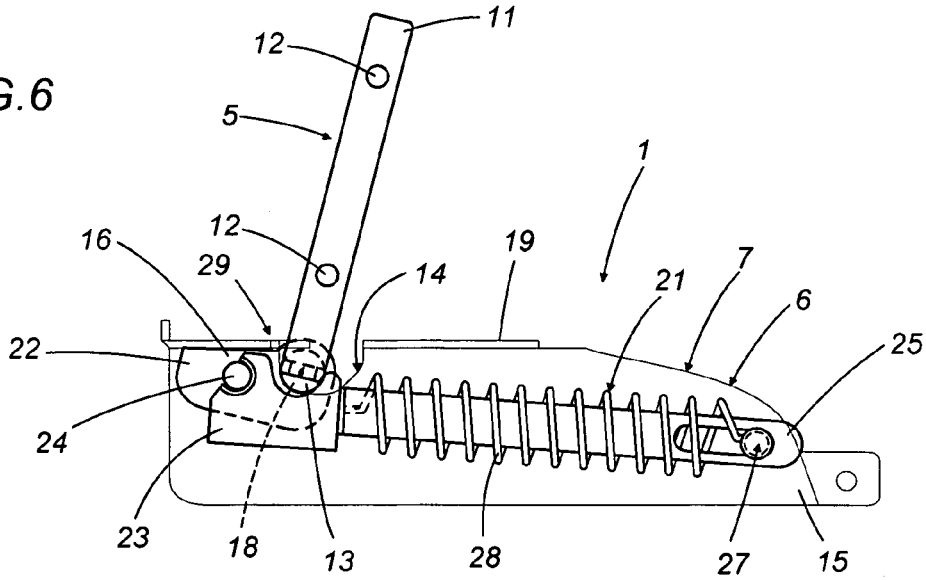

FIGS. 4, 5 and 6 show three respective positions of the element 5, corresponding to the closed position, an intermediate open position and the fully open position of the door 4.

As may be inferred from the above description, the first element 5 and the lever 8 together constitute a rocker lever 29 which is pivoted on the second element 6 and in which a first arm, defined by the second wing 11 of the first element 5 is designed to rotate, during the reciprocal motion of the first and the second element 5, 6, in a plane outside the box-shaped body 7 and parallel to the plane in which the second arm of the rocker lever 29 lies and about which it rotates, said second arm being defined by the second portion 22 of the lever 8.

This enables the box-shaped body 7 to be enclosed in the respective side wall of the washing machine or dishwasher 2, with one end 17 of the pin 13, to which the element 5 is fitted, protruding from a through hole made in the side wall (FIGS. 3 and 3*a*).

Thus, the box-shaped body 7 and the elastic means 21 are enclosed within, and protected by, the casing 3.

To make the protection of the box-shaped body 7 and of the elastic means 21 watertight, the end 17 of the pin 13 which protrudes from the hole 30 has a collar-like watertight seal 31 which adheres to the edge of the hole 30 (FIGS. 3 and 3*a*).

Figure 7:
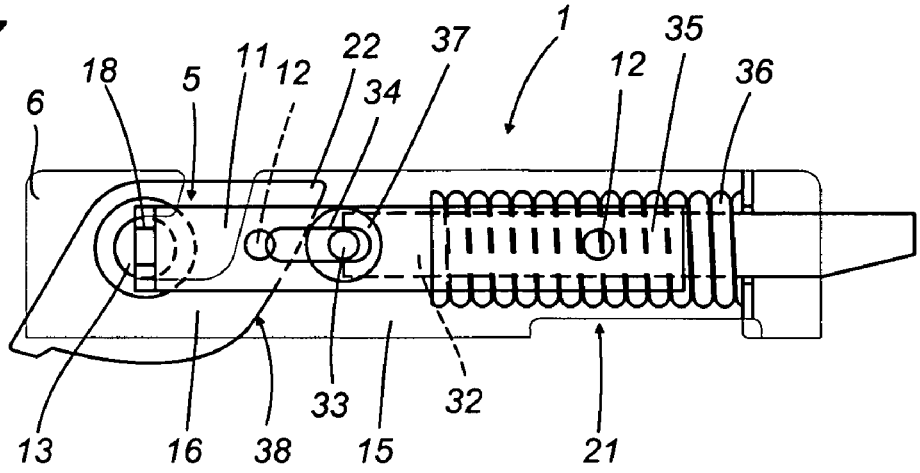
FIG. 7 is a side view of a second embodiment of the hinge according to the present invention, showing the hinge in the closed position.

In the embodiment illustrated in FIG. 7, where the hinge 1 is shown in the closed position, as in FIG. 4, but opens in anti-clockwise direction and not clockwise, the elastic means 21 comprise: a fork 32, hinged to a pin 33, the latter extending at right angles between the side walls 15 and being slidably coupled with two respective slots 34 in the side walls 15; a rod 35, fixed at one longitudinal end to the fork 32 and at the opposite longitudinal end to the box-shaped body 7; a pre-compressed helical spring 36 coaxial with the rod 35 and fitted between the fork 32 and the box-shaped body 7; and a cam follower 37 slidably mounted on the pin 33 between the two arms of the fork 32 which follows a cam 38 defined by the end profile of the portion 22 of the lever 8.

In this embodiment, the lever 8 does not have the pin 24.

In this embodiment also, when the door 4 is rotated about the axis A, thereby rotating the elements 5 about their respective axes 13*a*, the pushing force of the spring 36 acts on the lever 8 with a variable intensity according to the angular position of the lever 8, that is to say, the angular position of the cam 38. In particular, the action of the spring 36 is variable and concordant with that of the user when the door 4 is opened, whilst it is variable and discordant when the door is closed. The variability of the action of the spring 28 is defined by the profile of the cam 38 and by the geometry of the elastic means 21.

Figure 7A:
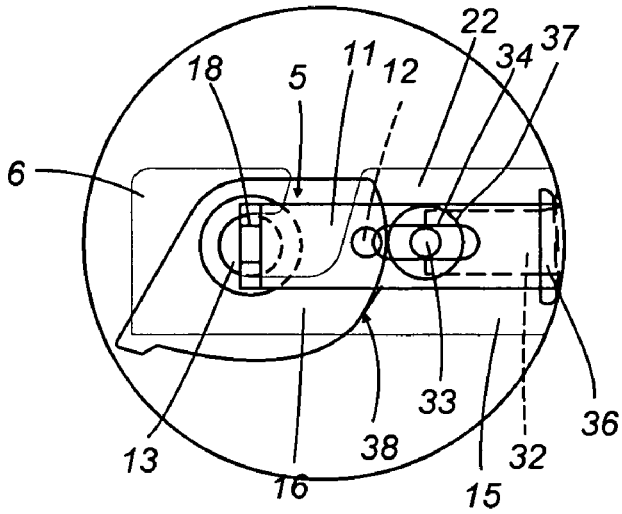
FIG. 7*a* shows a different embodiment of a detail from FIG. 7.

In the detail illustrated in FIG. 7*a*, the end profile of the portion 22 of the lever 8 has a curvature radius that is shorter than the one shown in FIG. 7 and the end profile is closer to the fitting 18. Thus, the open position of the door 4 is more stable under the action of the cam follower 37 which is pushed into contact with the cam 38 profile by the spring 36.

It will be understood that the two embodiments described above may be modified and adapted in several way without departing from the spirit of the invention. For example, the hinges 1 may be mounted on other types of domestic appliance, such as ovens, or they may be used to support doors to be used in very damp or dusty environments.

Further, the elements 5 and 6 may exchange functions.

What is claimed is:

1. A door hinge comprising a first element, a second element and a lever connecting the first and second elements to each other; the lever being pivoted on the second element and having a first portion attached to the first element to make the first and the second element reciprocally mobile about a horizontal axis; the second element consisting of a box-shaped body housing an elastic means for acting in conjunction with a second portion of the lever to control the reciprocal motion of the first and the second element; wherein the first element and the lever of the hinge constitute a rocker lever pivoted on the second element and in which the first element comprises a first arm which is rotatable with respect to the second element in a first plane outside the box-shaped body and parallel to a second plane in which a second arm of the rocker lever lies and about which the rocker rotates, said second arm being defined by the second portion of the lever.

2. The hinge according to claim 1, wherein the first element comprises a first wing fixable to the first portion of the lever and extending at a right angle from said first arm.

3. The hinge according to claim 2, wherein the first portion of the lever comprises a rotation pin by which the lever is pivoted on the second element.

4. The hinge according to claim 3, wherein the first wing is fixable to the pin as an axial extension of the pin.

5. The hinge according to claim 4, wherein the box-shaped body comprises at least two opposite side walls, and wherein one longitudinal end of the pin constitutes a fitting for the rapid connection of the first wing to the lever; the fitting being accessible from the outside of the box-shaped body at one of the two opposite side walls of the box-shaped body itself.

6. The hinge according to claim 5, wherein said longitudinal end of the pin protrudes from the side wall of the box-shaped body and is fitted with a watertight collar seal.

7. The hinge according to claim 4, wherein the longitudinal ends of the pin constitute two fittings, one at each end, for the rapid connection of the first wing to the lever; the fittings being accessible from the outside of the box-shaped body at the respective opposite side walls of the box-shaped body itself.

8. The hinge according to claim 7, wherein said longitudinal ends of the pin protrude from the respective side walls of the box-shaped body and is fitted with watertight collar seals.

9. A hinge comprising a first element, a second element and a lever connecting the first and second elements to each other; the lever being pivoted on the second element and having a first portion attached to the first element to make the first and the second element reciprocally mobile about a horizontal axis; the second element housing an elastic means for acting in conjunction with a second portion of the lever to control the reciprocal motion of the first and the second element; wherein a first arm, defined by the first element, is rotatable, during the reciprocal motion of the first and the second element, in a plane outside the second element; the first portion of the lever defining a rotation pin by which the lever is pivoted on the second element; a longitudinal end of the pin protruding from a side wall of the second element and being fitted with a watertight collar seal.

* * * * *